United States Patent [19]

McMahon

[11] Patent Number: 4,858,206

[45] Date of Patent: Aug. 15, 1989

[54] RING-SHELL PROJECTOR

[75] Inventor: Garfield W. McMahon, Dartmouth, Canada

[73] Assignee: Minister of National Defence of Her Majesty's Canadian Government, Ottawa, Canada

[21] Appl. No.: 295,529

[22] Filed: Jan. 10, 1989

[30] Foreign Application Priority Data

Mar. 11, 1988 [CA] Canada ..... 561240

[51] Int. Cl.[4] ..... H04R 17/00

[52] U.S. Cl. ..... 367/163; 367/174; 367/167; 310/337; 29/594

[58] Field of Search ..... 367/163, 174, 165, 166, 367/155, 167; 310/337; 29/594, 25.35

[56] References Cited

U.S. PATENT DOCUMENTS 3,845,333 10/1974 Holloway ..... 310/337
3,992,693 11/1976 Martin et al. ..... 310/337
4,435,794 3/1984 Marshall, Jr. et al. ..... 310/337

FOREIGN PATENT DOCUMENTS 1171950 7/1984 Canada .
1202406 3/1986 Canada .

*Primary Examiner*—Deborah L. Kyle
*Assistant Examiner*—J. Woodrow Eldred
*Attorney, Agent, or Firm*—Roylance, Abrams, Berdo & Goodman

[57] ABSTRACT

A ring-shell projector capable of simple disassembly and reassembly. The underwater transducer has a driving ring and a pair of flexible diaphragms on either side of the ring with their rims attached to the ring. The ring is formed of an array of electrostrictive elements and spacer elements, each spacer element having a pair of radial, outward extensions. A pair of coupling rings are provided each adapted to be positioned between the rim of one flexible diaphragm and a corresponding array of spacer element extensions to provide sealing engagement between the flexible diaphragms and the driving ring. Besides simplifying the repair of a projector, the improved design is more versatile, allowing a single driving ring to be used with different sets of shells, having different resonance frequencies and/or bandwidths. Moreover, an expensive step in the construction of a ring-shell projector is obviated, namely, the bolt holes in the metal staves and the subsequent custom matching of the shell holes.

5 Claims, 2 Drawing Sheets

RING-SHELL PROJECTOR

The present invention relates to underwater transducers of the type having a driving ring or collar of electrostrictive material and flexible diaphragms covering the top and bottom of the driving ring. Similar underwater transducers are described in applicant's Canadian Pats. No. 1,171,950 and 1,202,406.

In particular, this invention relates to an improvement which allows a single driving ring to be used in conjunction with different sets of diaphragms, and facilitates assembly, disassembly and maintenance.

It is known to provide underwater transducers that have a driving ring or collar of electrostrictive material with flexible diaphragms that cover the top and bottom of the driving ring. As the ring vibrates radially, the vibration is communicated in amplified form to the diaphragms and then coupled directly to the water. The transducers disclosed in Canadian Pats. Nos. 1,171,950 and 1,202,406 eliminate the high thermally induced stresses associated with previous transducers and increase the maximum operating depth of the underwater transducer.

A disadvantage of known transducers has been that disassembly and reassembly for any reason, such as maintenance or change of characteristics, has been tedious and costly, and risked the destruction of valuable components of the projector if not its total destruction. The piezoelectric ring is a composite assembly comprising many piezoelectric ceramic plates, many metal staves containing bolt holes, and an outer wrapping of fiberglassepoxy. Because the assembly is made up of many parts and bonded together with an adhesive such as epoxy, it cannot be made with a high degree of precision. It is therefore necessary to drill the bolt holes in the shells to match the existing holes in the metal staves, after assembly of the driving ring. Also, the shells must be bonded as well as bolted to the driving ring to provide waterproofing and to provide the necessary rigid mechanical contact between the shells and the ring.

The present invention proposes a change in the design of ring-shell projectors that will allow simple disassembly and reassembly. Besides simplifying the repair of a projector, the improved design is more versatile, allowing a single driving ring to be used with different sets of shells, having different resonance frequencies and/or bandwidths. Moreover, an expensive step in the construction of a ring-shell projector is obviated, namely, the bolt holes in the metal staves and the subsequent custom matching of the shell holes.

Specifically, the invention relates to an underwater transducer having a driving ring and a pair of flexible diaphragms on either side of the ring with their rims attached to the ring. The ring is formed of an array of electrostrictive elements and spacer elements, each spacer element having a pair of radial, outward extensions. A pair of coupling rings are provided each adapted to be positioned between the rim of one flexible diaphragm and a corresponding array of spacer element extensions to provide sealing engagement between the flexible diaphragms and the driving ring.

In its method aspect, the invention relates to a method of assemblying an underwater transducer having a driving ring and a pair of flexible diaphragms on either side of the ring with their rims attached to the ring, the ring being formed of an array of electrostrictive elements and spacer elements, each spacer element having a pair of radial, outward extensions. The method comprising the steps of: assembling the driving ring; machining the outward extensions to provide surfaces adapted to mate with corresponding surfaces of a pair of coupling rings; assembling the coupling rings to the driving ring; machining the rims of the diaphragms to provide surfaces adapted to mate with corresponding surfaces on outer portions of the coupling rings; assembling the diaphragms to the coupling rings; and securing the diaphragms to provide a sealed transducer assembly.

The invention will be described with reference to the accompanying drawings in which.

DESCRIPTION OF THE PREFERRED EMBODIMENT

A transducer according to this invention includes the combination of electrostrictive elements and staves or spacer elements arranged in a driving ring. Within the ring is a space which may house a water bladder assembly. A pair of flexible diaphragm shells are mounted on the driving ring.

Figure 1:
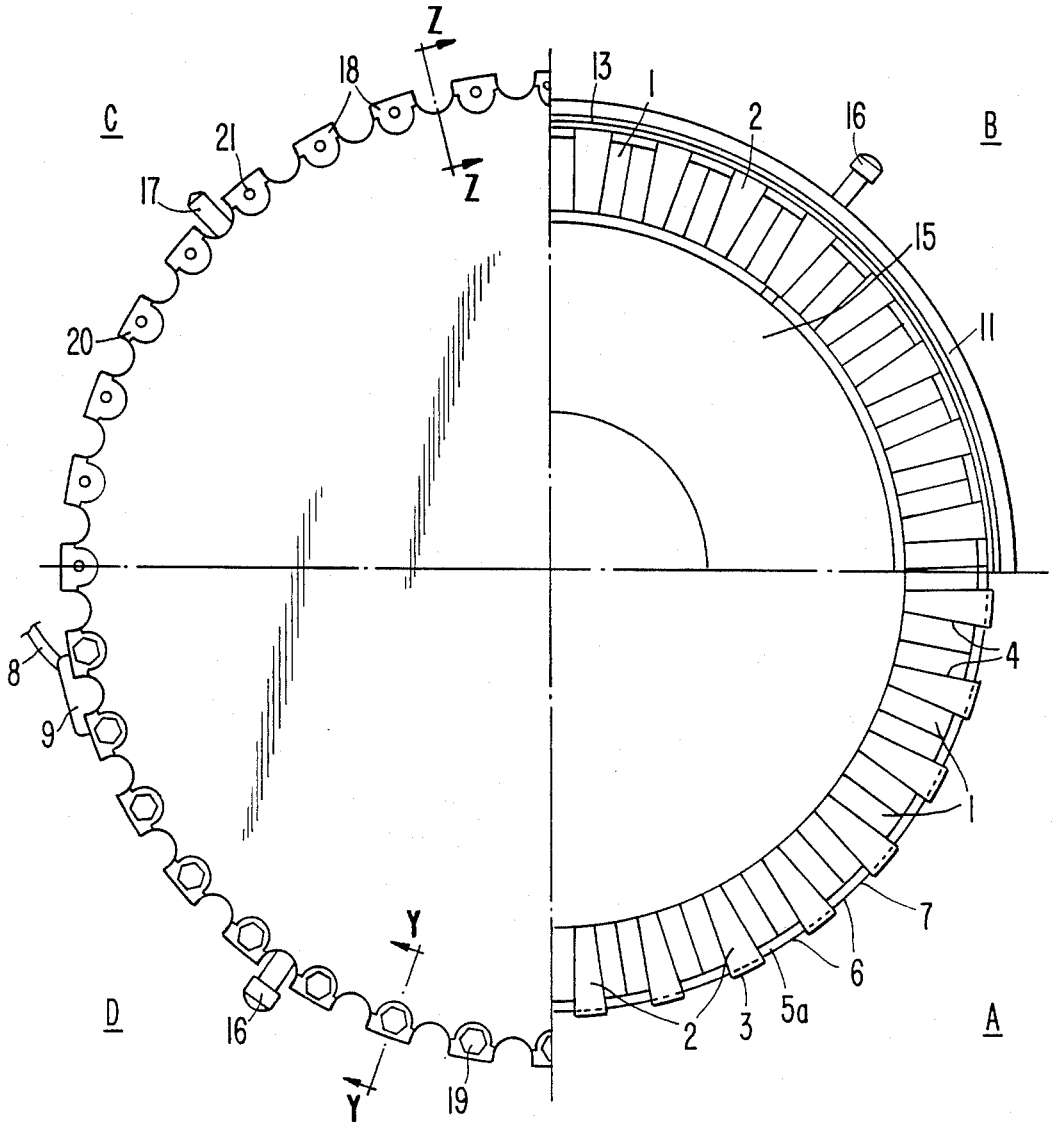
FIG. 1 is a plan view of the transducer, with cutaway sections showing different stages of assembly.

FIG. 1 shows a plan view of a ring shell projector, partially cut away to illustrate four different stages in its manufacture and assembly. These states are labelled A, B, C and D and represent the chronological order of assembly. Stage A depicts the driving ring alone, which is made up of piezoelectric ceramic plate 1, typically of lead zirconate-titanate. Between each pair of ceramic plates is a wedge or stave 2 of metal such as steel. The ceramic plates 1 and metal staves 2 are bonded together in a ring, with a thin adhesive layer 4 between each piece. The ceramic plates are connected electrically in the same way as described in Canadian Pat. No. 1,171,950. The ring is given a compressive bias by an outer wrapping of fiberglass reinforced plastic 5*a*, 5*b*.

Figure 2:
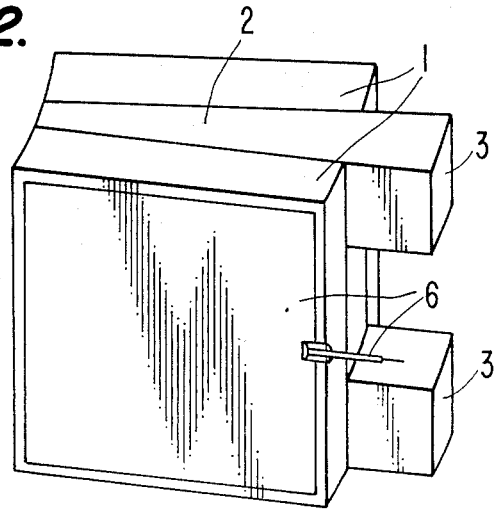
FIG. 2 is a perspective view of a metal stave between two piezoelectric plates.

As shown in detail in FIG. 2, which depicts a segment of the ring consisting of one metal stave 2 and two adjacent ceramic plates 1, each metal stave 2 is formed with a pair of extensions 3 projecting radially outward from the ring. The projecting extensions 3 are separated by a gap, and initially, are longer than necessary, to allow for precision machining later in the construction process. A high voltage electrode 6 of a ceramic plate is shown with one means for connecting it to the ceramic plate. The sharpened pin is soldered into a notch in the silver electrode surface; the sharp end penetrates the initial fiberglass wrapping for later electrical connection and over-wrapping.

The reinforced fiberglass wrapping is applied in two parts. The first part 5*a* is applied between the stave extensions 3. Then a conductor 7 (FIG. 3) is electrically connected to all the high voltage electrodes 6. This completes the construction of the stage depicted at A in FIG. 1. The second reinforced fiberglass layer 5*b*, which encloses the conductor 7, is applied after some further manufacturing operations to be described next.

Figure 3:
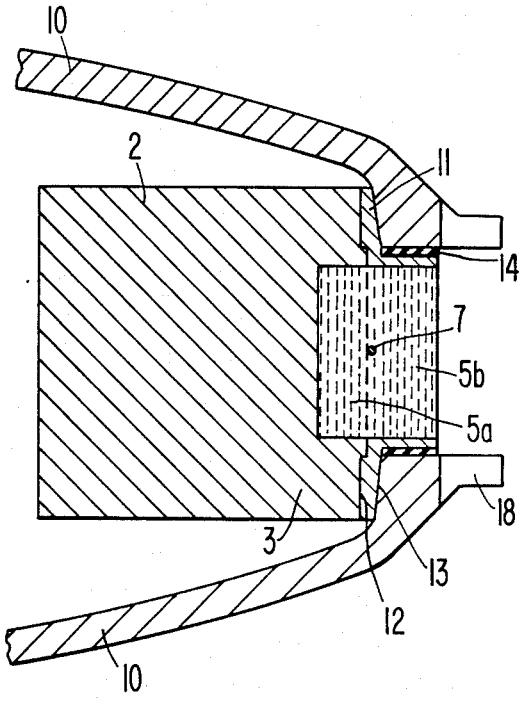
FIG. 3 is a cross-sectional view through a metal stave taken along line Z—Z of FIG. 1 showing the driving ring and edges of the diaphragm shells.

The assembled ring, with its first reinforced fiberglass layer 5a, is mounted on a lathe and the stave extensions 3 are precision machined to match with two coupling rings 11, also precision machined. The result is shown in FIG. 3, which is a cross-sectional view of the transducer taken through a metal stave 2 (Z—Z in FIG. 1). The stave extensions 3 and the coupling rings 11 have been machined to match closely along a surface 12. Each coupling ring is also machined along a conical surface 12 to engage a matching conical surface machined on the edge portion of the diaphragm shell 10. Each coupling ring 11 further includes a radially-extending flat section that matches with a corresponding flat section on the edge portion of the diaphragm shell, leaving a space between the two flat sections to accommodate a sealing gasket 14.

After these machining procedures, the coupling rings 11 are pressed and bonded to the matching stave extensions 3. The outer reinforced fiberglass layer 5b is applied under tension over the inner layer 5a, between the two flat sections of the coupling rings 11 enclosing the conductor 7, as shown in FIG. 3. An optional water bladder assembly 15 may be mounted in the interior of the driving ring, as described in Canadian Pat. No. 1,171,950 or Canadian Pat. No. 1,202,406 and fitted with any necessary water inlet port 16 (FIG. 1). The driving ring is also fitted with a gas inlet port 17 and an electrical cable 8 with cable boss 9, as described in Canadian Pat. No. 1,171,950. This completes the construction to stage B of FIG. 1, resulting in a driving ring assembly that can be used to drive any pair of diaphragm shells 10 that are machined to match the driving ring.

The shells 10 are prepared from metal, such as steel, to a shape that is substantially spherical over most of its area and with edges machined to match the coupling rings. 11. The shells are further adapted to have several tabs 18 extending radially outwards, each tab having a flat portion 20 and a drilled hole 21 as shown in Stage C of FIG. 1.

Figure 4:
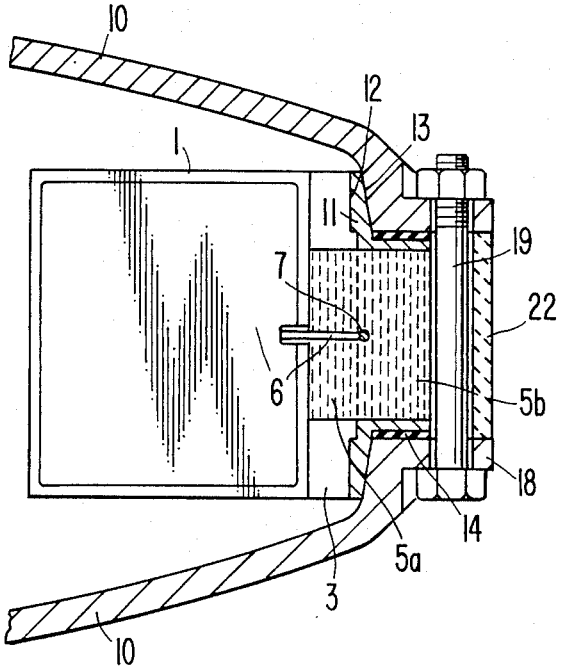
FIG. 4 is a similar cross-sectional view through a securing bolt taken along line Y—Y in FIG. 1 showing the driving ring and edges of the diaphragm shells.

The final transducer assembly is now described with reference to FIG. 4, which shows a detailed cross-sectional view taken through one of the tabs 18. Two gaskets 14 are positioned on the driving ring assembly and shells 10 are positioned on their respective matching conical surfaces 13 of the coupling rings 11. The two diaphragm shells are positioned so that the tab holes 21 of one shell align with the corresponding tab holes of the opposing shell. The shells are then pressed on to the driving ring assembly either by forcing the two shells together in a press or by progressively tightening bolts 19 placed in the aligned pairs of holes 21. A spacer 22 adjacent each bolt determines the degree to which the bolt is tightened and determines the final separation between the tabs 18, thereby controlling the compression of the gaskets 14 and the positions of the matching conical shell surfaces. The spacers 22 can take the form of a partial sleeve around each bolt. This completes the construction to Stage D in FIG. 1.

In aligning the shells on the driving ring, the tabs will normally be positioned between the metal staves. This allows any water inlet and gas inlet ports to emerge between the bolts from special metal staves, as described in Canadian Pat. No. 1,171,950. The cable boss 9 is also designed to emerge between a pair of bolts.

Some of the transducer features described above are intended to reduce the hoop stiffness of components that attach to the driving ring: e.g. the coupling ring has a small cross-sectional area; the shell edges are cut away to form tabs; the spacers are separate pieces for each bolt rather than a continuous hoop. These features enhance the electromechanical coupling of strain energy from the piezoelectric driving ring to the shells, and hence increase the acoustic power output from the projector.

Because of the presence of the metal stave extensions, less area on the outer surface of the piezoelectric ring is available for the reinforced fiberglass wrapping, and the compressive bias provided by the wrapping would be expected to be less than on previous transducer designs. This can be compensated by a compressive bias introduced when the shells are pressed onto the driving ring along the matching conical surfaces. In any case, the compressive stresses on the conical surfaces must be sufficient to exceed any dynamic or static tensile stresses that might be encountered during operation of the projector.

Thus, there has been described an improved underwater transducer permitting simple disassembly and reassembly. Various changes in the exact construction described will be clear to those skilled in the art. Such changes are intended to be included in the accompanying claims.

The embodiments of the invention in which an exclusive property or privilege is claimed are defined as follows:

1. An underwater transducer having a driving ring and a pair of flexible diaphragms on either side of the ring with their rims attached to the ring, the ring being formed of an array of electrostrictive elements and spacer elements, each spacer element having a pair of radial, outward extensions, a pair of coupling rings each adapted to be positioned between the rim of one flexible diaphragm and a corresponding array of spacer element extensions to provide sealing engagement between the flexible diaphragms and the driving ring.

2. An underwater transducer as defined in claim 1 wherein the coupling rings are L-shaped in cross-section and further comprising an annular gasket located between a portion of the rim of each diaphragm and a corresponding portion of the extension.

3. An underwater transducer as defined in claim 1 wherein each diaphragm is provided with tabs extending radially beyond the coupling rings and adapted to receive fastening means.

4. An underwater transducer as defined in claim 3 wherein the fastening means comprises a bolt supporting a spacing element between the tabs, thereby to determine the separation of the diaphragms from one another.

5. A method of assemblying an underwater transducer having a driving ring and a pair of flexible diaphragms on either side of the ring with their rims attached to the ring, the ring being formed of an array of electrostrictive elements and spacer elements, each spacer element having a pair of radially, outward extensions; the method comprising the steps of:

assembling the driving ring;

machining the outward extensions to provide surfaces adapted to mate with corresponding surfaces of a pair of coupling rings;

assembling the coupling rings to the driving ring;

machining the rims of the diaphragms to provide surfaces adapted to mate with corresponding surfaces on outer portions of the coupling rings;

assembling the diaphragms to the coupling rings; and securing the diaphragms to provide a sealed transducer assembly.

* * * * *